US008133132B2

(12) United States Patent
Takeuchi

(10) Patent No.: US 8,133,132 B2
(45) Date of Patent: Mar. 13, 2012

(54) GOLF CLUB

(75) Inventor: Hiroyuki Takeuchi, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 85 days.

(21) Appl. No.: 12/372,473

(22) Filed: Feb. 17, 2009

(65) Prior Publication Data

US 2009/0325727 A1 Dec. 31, 2009

(30) Foreign Application Priority Data

Jun. 26, 2008 (JP) ..... 2008-167628

(51) Int. Cl.
*A63B 53/04* (2006.01)

(52) U.S. Cl. ..... 473/309

(58) Field of Classification Search ..... 473/288, 473/307–310

See application file for complete search history.

(56) References Cited

U.S. PATENT DOCUMENTS

| | | | | |
|---|---|---|---|---|
| 3,625,513 | A * | 12/1971 | Ballmer | 473/310 |
| 5,688,188 | A * | 11/1997 | Chappell | 473/309 |
| 2003/0199332 | A1 * | 10/2003 | Lindsay | 473/305 |

FOREIGN PATENT DOCUMENTS

| | | | |
|---|---|---|---|
| EP | 255324 | A2 * | 2/1988 |
| JP | 07185048 | A * | 7/1995 |
| JP | 09066123 | A * | 3/1997 |
| JP | 2003093552 | A * | 4/2003 |
| JP | 2006-158477 | A | 6/2006 |
| JP | 2006-158496 | A | 6/2006 |

* cited by examiner

*Primary Examiner* — Stephen L. Blau

(74) *Attorney, Agent, or Firm* — Birch, Stewart, Kolasch & Birch, LLP

(57) ABSTRACT

A golf club 2 is provided with a head 4, a shaft 6, and a ferrule 8. The head 4 has a hosel hole 22. The hosel hole 22 has a large-diameter part 24 and a small-diameter part 26. The ferrule 8 has a base part 30 interposed between the large-diameter part 24 and the shaft 6. The large-diameter part 24 is disposed coaxially with the small-diameter part 26. The shaft 6 has a tip end surface 40 disposed in the small-diameter part 26. The large-diameter part 24 has an axial directional length longer than that of the small-diameter part 26. Preferably, the base part 30 has an end surface 52 separated from the bottom surface 54 of the large-diameter part 24. Preferably, an adhesive v1 is disposed in an enclosed part 62 defined by the end surface 52 of the base part 30, the bottom surface 54 of the large-diameter part 24, the outer peripheral surface 58 of the shaft 6, and the inner peripheral surface 60 of the large-diameter part 24. The shaft 6 and the large-diameter part 24 are bonded by the adhesive v1.

12 Claims, 11 Drawing Sheets

GOLF CLUB

The present application claims priority from Japan Patent Application No. 2008-167628, filed Jun. 26, 2008, incorporated herein by reference in its entirety.

BACKGROUND OF THE INVENTION

1. Field of the Invention

The present invention relates to a golf club.

2. Description of the Related Art

A golf club usually has a head, a shaft and a grip. The head has a hosel hole. The shaft is inserted into the hosel hole, and the inner peripheral surface of the hosel hole and the outer peripheral surface of the shaft are bonded to each other.

Incidentally, the golf club usually has a ferrule. The ferrule is also referred to as a socket. Usually, the ferrule has an outer surface formed into a conical surface shape and an outer diameter gradually decreasing to the grip side from the head side. This ferrule obscures the end surface of a hosel part of the head. The ferrule is useful for improving the outer appearance of the golf club.

A ferrule provided with a base part for being inserted into a hosel hole unlike in a general ferrule has been known. Japanese Patent Application Laid-Open Nos. 2006-158496 and 2006-158477 disclose a ferrule provided with a base part for being inserted into a hosel hole. This base part is provided in order to relax stress concentration which is apt to be generated between the end surface of the hosel and the shaft.

SUMMARY OF THE INVENTION

The inner diameter of the hosel hole is determined in accordance with the outer diameter of the tip part of the shaft. In order to satisfy preconditions of enabling the insertion of the shaft and of interposing an adhesive between the shaft and the hosel hole, the inner diameter of the hosel hole is made to be slightly larger than the outer diameter of the tip part of the shaft. However, as long as the preconditions are satisfied, the difference between the inner diameter of the hosel hole and the outer diameter of the tip part of the shaft is reduced as much as possible. Such a situation makes it difficult to attach two kinds of shafts having different tip diameters to the same head.

It is an object of the present invention to provide a golf club to which shafts having different tip diameters can be attached.

A golf club according to the present invention includes a golf club head, a shaft and a ferrule. The head has a hosel hole. The hosel hole has a large-diameter part positioned at an opening side of the hosel hole and a small-diameter part provided below the large-diameter part. The ferrule has a base part interposed between the large-diameter part and the shaft. The large-diameter part is disposed coaxially with the small-diameter part. The shaft has a tip end surface disposed in the small-diameter part. The large-diameter part has an axial directional length longer than that of the small-diameter part.

Preferably, the base part has an end surface separated from a bottom surface of the large-diameter part. Preferably, an adhesive is disposed in an enclosed part defined by the end surface of the base part, a bottom surface of the large-diameter part, an outer peripheral surface of the shaft and an inner peripheral surface of the large-diameter part. The shaft and the large-diameter part are bonded by the adhesive.

Preferably, the base part has an end surface separated from a bottom surface of the large-diameter part. Preferably, an adhesive and an interposition member are disposed in an enclosed part defined by the end surface of the base part, the bottom surface of the large-diameter part, the outer peripheral surface of the shaft, and the inner peripheral surface of the large-diameter part.

Preferably, the base part has an axial directional length half or smaller than that of the large-diameter part.

Preferably, the large-diameter part has an axial directional length of 20 mm or more.

Preferably, when a inner diameter of the large-diameter part is d3 (mm), a tip diameter of the shaft is d1 (mm) and a value calculated in the following calculating formula (1) is S1, a thickness t2 of the interposition member is 50% or more of the value S1, and the thickness t2 of the interposition member is 90% or less of the value S1.

$$S1=(d3-d1)/2 \quad (1)$$

Preferably, an area of the inner peripheral surface of the large-diameter part is 500 $mm^2$ or more, and 1500 $mm^2$ or less.

Preferably, an axial directional length L3 of the small-diameter part is 1 mm or more, and 15 mm or less.

Preferably, a insertion length L4 of the shaft into the small-diameter part is 1 mm or more, and 10 mm or less.

Preferably, an axial directional length L2 of the base part is 4 mm or more, and 22 mm or less.

Preferably, a ratio (L2/L1) of an axial directional length L2 (mm) of the base part to an axial directional length L1 (mm) of the large-diameter part is 0.05 or more, and 0.5 or less.

Preferably, a difference (d3−d7) between an outer diameter d7 (mm) of the base part and a inner diameter d3 (mm) of the large-diameter part is 0.05 mm or more, and 0.3 mm or less.

Preferably, a radial thickness t3 of the enclosed part is 0.1 mm or more, and 1 mm or less.

Preferably, a difference (d3−d2) between a inner diameter d3 (mm) of the large-diameter part and a inner diameter d2 (mm) of the small-diameter part is 0.2 mm or more, and 1.5 mm or less.

According to the golf club, a shaft having a tip diameter corresponding to the small-diameter part and a shaft having a tip diameter corresponding to the large-diameter part can be attached.

DESCRIPTION OF THE PREFERRED EMBODIMENTS

Hereinafter, the present invention will be described in detail based on preferred embodiments with reference to the suitable drawings.

In the present application, words which show upper and lower sides such as the terms "upper end", "above", "lower end", and "below" are used. In the present application, the term "upper" means an upper side in a shaft axial line Z1 direction. That is, the term "upper" means a shaft rear end side or a grip side of a golf club. The term "lower" means a lower side in the shaft axial line Z1 direction. That is, the term "lower" means a sole side of a head. If not otherwise specified, in the present application, the term "axial direction" means the shaft axial line Z1 direction. The term "circumferential direction" means a circumferential direction to this axial direction. The term "radial direction" means a direction perpendicular to the axial direction.

Figure 1:
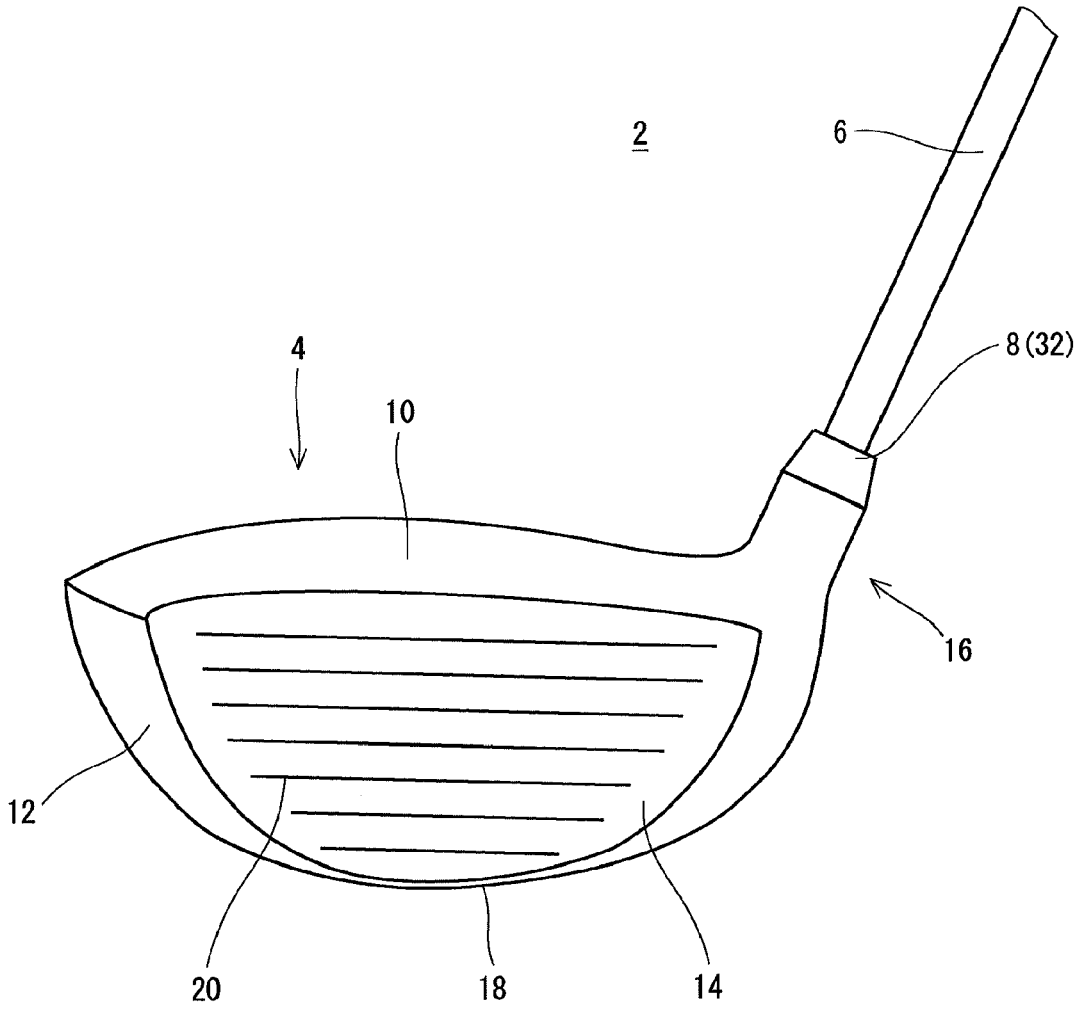
FIG. 1 shows the vicinity of a head of a golf club according to one embodiment of the present invention.
Figure 2:
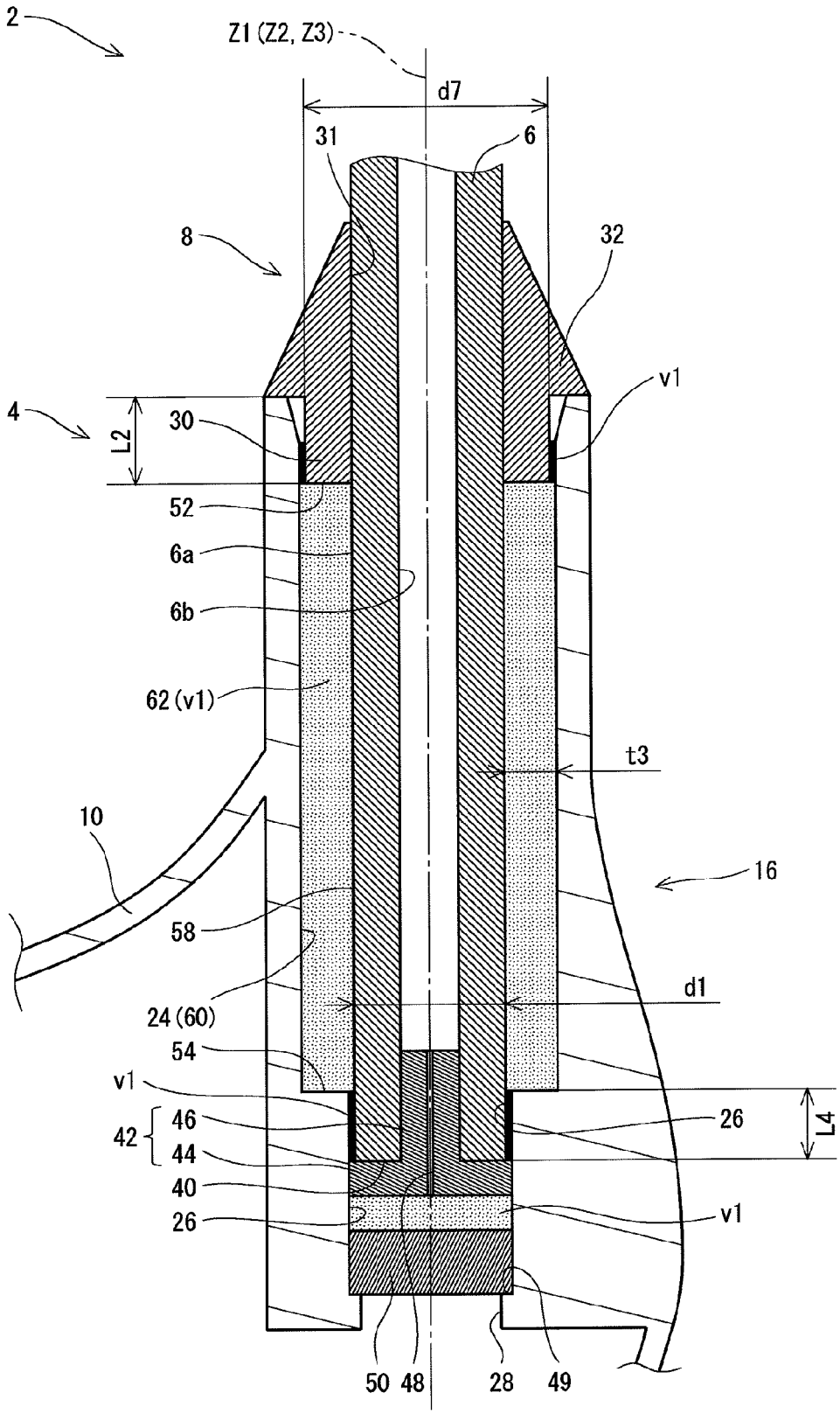
FIG. 2 is a sectional view showing the vicinity of a hosel of the golf club of FIG. 1.
Figure 3:
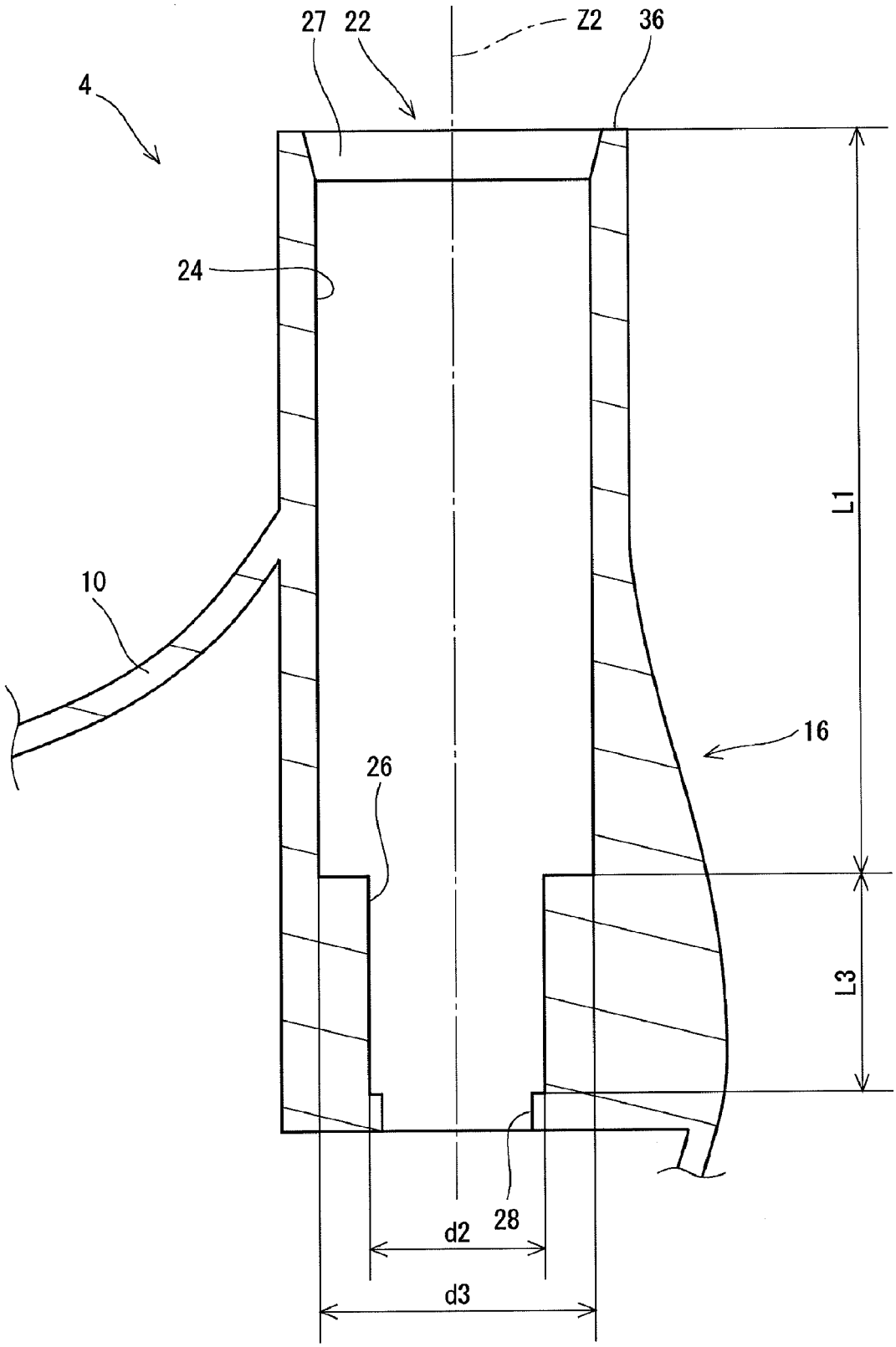
FIG. 3 is a sectional view showing the vicinity of the hosel of the head used for the golf club of FIG. 1.
Figure 4:
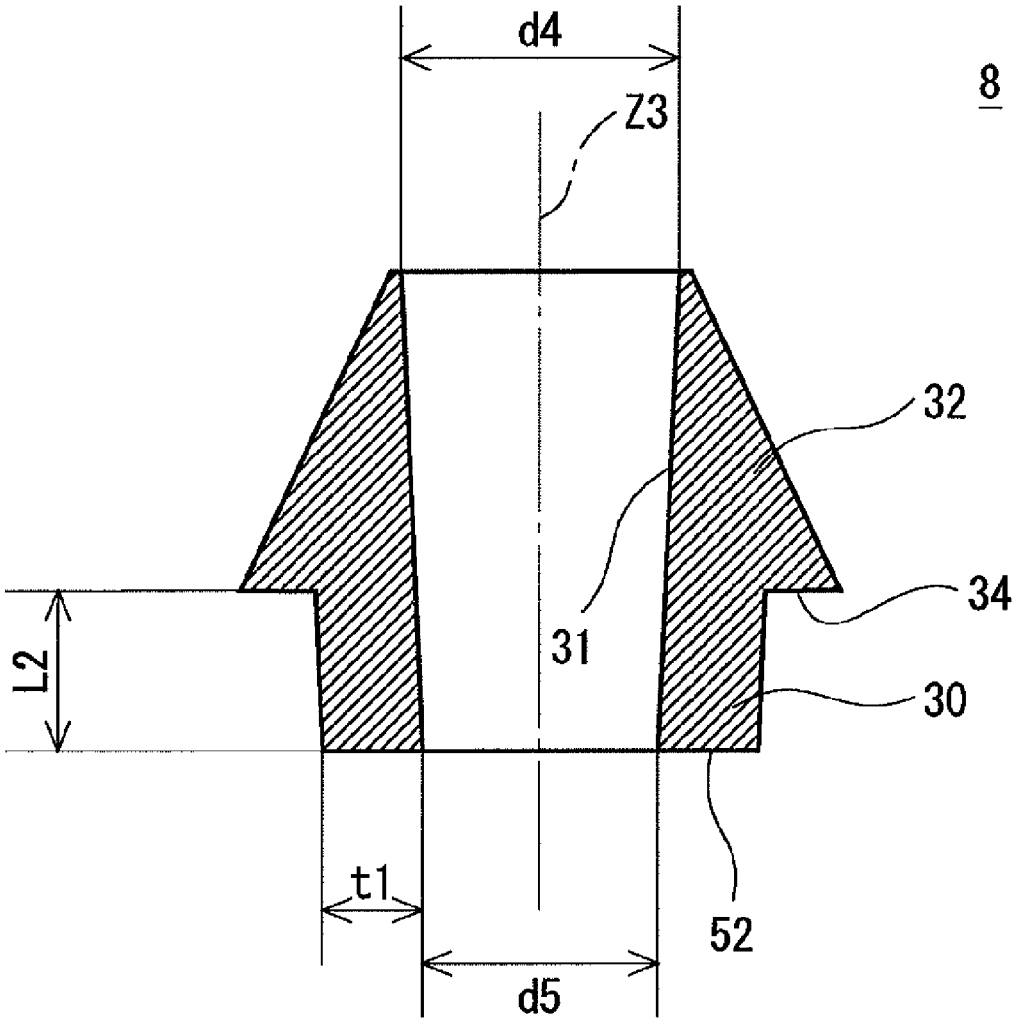
FIG. 4 is a sectional view of a ferrule used for the golf club of FIG. 1.

FIG. 1 shows a part of a golf club 2 according to a first embodiment of the present invention. FIG. 2 is a sectional view of the golf club 2 in the vicinity of a hosel 16. FIG. 2 is a sectional view along a shaft axial line Z1. FIG. 3 is a sectional view of a head 4 in the vicinity of the hosel 16. FIG. 3 is a part of FIG. 2. FIG. 3 is a sectional view along an axial line Z2 of a hosel hole. FIG. 4 is a sectional view of a ferrule 8. FIG. 4 is a sectional view along an axial line Z3 of the ferrule. In the golf club 2, the axial line Z1 and the axial line Z2 are substantially identical with each other. In the golf club 2, the axial line Z1 and the axial line Z3 are substantially identical with each other.

The golf club 2 has a head 4, a shaft 6, and a ferrule 8. The shaft 6 has a first end part to which the head 4 is attached. The shaft 6 has a second end part to which a grip is attached (not shown). The shaft 6 has a tubular shape. The shaft has an outer surface 6*a* as a circumferential surface. The shaft 6 has an inner surface 6*b* as a circumferential surface.

The head 4 is a wood type golf club head. The head 4 has a crown 10, a side 12, a face 14, a hosel 16, and a sole 18. The head 4 is hollow. Face lines 20 are formed on the face 14. The head 4 may be an iron type golf club head or may be other any types of heads.

As shown in FIG. 3, the head 4 has a hosel hole 22. The hosel hole 22 has an annular section shape (a shape in a cross section perpendicular to the axial line Z2). The hosel hole 22 has a large-diameter part 24 positioned at the opening side of the hosel hole 22 and a small-diameter part 26 provided below the large-diameter part 24. The large-diameter part 24 has a diameter larger than that of the small-diameter part 26. The large-diameter part 24 is disposed coaxially with the small-diameter part 26. That is, the axial line of the large-diameter part 24 is the axial line Z2, and the axial line of the small-diameter part 26 is also the axial line Z2.

In the embodiment, the small-diameter part 26 is provided successively to the large-diameter part 24. The large-diameter part 24 and the small-diameter part 26 may be separated from each other. For example, a hole having a diameter gradually decreasing as it goes downward may be formed between large-diameter part 24 and the small-diameter part 26. The small-diameter part 26 is preferably formed successively to the large-diameter part 24 from the viewpoint of suppressing the length of the hosel hole 22.

A chamfer 27 is formed in the upper end of the large-diameter part 24. The chamfer 27 can relax the stress concentration to the shaft.

The lower side of the small-diameter part 26 may be closed or be opened. In the embodiment, the lower side of the small-diameter part 26 is opened. However, a through-hole 28 having a diameter smaller than that of the small-diameter part 26 is formed below the small-diameter part 26 from the viewpoint of fixing a plug to be described later.

Thus, in the embodiment, the lower side of the hosel hole 22 is opened, and the inside of the hosel hole 22 and the hollow part of the head 4 are communicated with each other. Therefore, in the head 4, a weight adjusting material can be injected into the head from the hosel 16. As this injecting method, for example, there can be adopted a method for inserting a pipe having an outlet at a tip into the hosel hole 22 and discharging the weight adjusting material from this outlet in a state where this outlet reaches the hollow part of the head 4. It is preferable that the weight adjusting material has fluidity when the weight adjusting material is injected and can adhere to the inner wall of the head after the weight adjusting material is injected. As this weight adjusting material, for example, a thermoplastic material is adopted.

A recess or a projection may be provided on at least a part of the inner peripheral surface of the hosel hole 22. For example, a tap (shave) may be formed on at least a part of the inner peripheral surface of the hosel hole 22. The recess or the projection contributes to the increase in an adhesion area. The recess or the projection can provide an anchor effect.

The ferrule 8 has a base part 30, a through-hole 31, and an exposed part 32. In the golf club 2, the shaft 6 is inserted into the through-hole 31. In the golf club 2, the exposed part 32 is positioned above the base part 30. As shown in FIG. 2, in the golf club 2, the base part 30 is disposed in the hosel hole 22. The base part 30 has a cylindrical shape. The base part 30 is interposed between the large-diameter part 24 and the shaft 6. In the golf club 2, the base part 30 is not visually recognized. In the golf club 2, the exposed part 32 is exposed to the outside. The outer surface of the exposed part 32 is a conic surface.

As shown in FIG. 4, a bump surface 34 exists in the lower end of the exposed part 32. The bump surface 34 extends in the radial direction. The bump surface 34 is an annular plane. The outer diameter of the bump surface 34 is the maximum diameter of the exposed part 32. The outer diameter of the bump surface 34 is substantially the same as the outer diameter of the end surface 36 of the hosel. A plane including the bump surface 34 defines a boundary between the base part 30 and the exposed part 32. The bump surface 34 and an end surface 36 are brought into contact with each other. The bump surface 34 and the end surface 36 may be bonded by an adhesive.

As shown in FIG. 2, the tip part of the shaft 6 is inserted into the small-diameter part 26. A tip end surface 40 of the shaft 6 is disposed in the small-diameter part 26. The tip part of the shaft 6 is inserted into the small-diameter part 26.

A bush 42 is provided below the tip end surface 40. The balance of the golf club 2 can be adjusted by the bush 42. The bush 42 has a large-diameter part 44, a small-diameter part 46, and a through-hole 48. The large-diameter part 44 and the small-diameter part 46 have a cylindrical shape. The large-diameter part 44 and the small-diameter part 46 are disposed coaxially with each other. The through-hole 48 extends along the axial line of the bush 42. The through-hole 48 is a hole for extracting air. The small-diameter part 46 is inserted into the hollow part of the shaft 6. The bush 42 may not have the small-diameter part 46.

An adhesive layer exists between the bush 42 and the shaft 6 (not shown). The bush 42 and the shaft 6 are bonded by the adhesive. The bush 42 may not exist.

As shown in FIG. 2, the tip end surface 40 of the shaft 6 and the bottom surface 49 of the small-diameter part 26 are not brought into contact with each other. An adhesive v1 exists between the tip end surface 40 of the shaft 6 and the bottom surface 49. This configuration can suppress the deviation between the shaft axial line Z1 and the axial line Z2 of the hosel hole. Reason for this is as follows. When a plane including the tip end surface 40 of the shaft 6 and/or a plane including the bottom surface 49 is not perpendicular to the axial line Z2 of the hosel hole, the deviation between the axial line Z1 and the axial line Z2 may be generated due to the abutment between the tip end surface 40 of the shaft 6 and the bottom surface 49. Also, when the tip end surface 40 and/or the bottom surface 49 are not a plane, the deviation between the axial line Z1 and the axial line Z2 may be generated due to the abutment between the tip end surface 40 of the shaft 6 and the bottom surface 49. Therefore, the separation of the tip end surface 40 and the bottom surface 49 can suppress the deviation between the axial line Z1 and the axial line Z2. From the viewpoint of suppressing the deviation between the axial line Z1 and the axial line Z2, a space may exist between the tip end surface 40 and the bottom surface 49.

A plug 50 is provided in the small-diameter part 26. The plug 50 is provided in a position below the tip end surface 40 of the shaft 6. The plug 50 is a cylindrical member. The lower side of the small-diameter part 26 is closed by the plug 50. The plug 50 may be bonded to the small-diameter part 26 by an adhesive. The plug 50 is made of, for example, rubber. The plug 50 suppresses the penetration of the adhesive into the hollow part of the head 4. The plug 50 may not exist.

The adhesive v1 exist between the plug 50 and the bush 42. The adhesive v1 may not exist.

The adhesive is shown by a dotted pattern (dot) or a thick line in the drawings (FIG. 2 or the like) of the present application. A thin adhesive layer is shown by the thick line. The thick line is drawn thicker than an actual adhesive layer from the viewpoint of facilitating the understanding of the drawings.

A tip diameter d1 (mm) of the shaft 6 corresponds to an inner diameter d2 (mm) of the small-diameter part 26. Specifically, the difference (d2−d1) is preferably 0.2 mm or less, and more preferably 0.1 mm or less. The deviation between the shaft axial line Z1 and the axial line Z2 of the hosel hole is suppressed by reducing the difference (d2−d1). The adhesive strength between the inner peripheral surface of the small-diameter part 26 and the shaft 6 is likely to be enhanced by reducing the difference (d2−d1). From the viewpoint of facilitating the insertion of the shaft 6 into the small-diameter part 26, the difference (d2−d1) is preferably 0.01 mm or more, more preferably 0.02 mm or more, and still more preferably 0.05 mm or more. The tip diameter of the shaft 6 means the outer diameter of the shaft 6 in a portion inserted into the hosel hole 22.

The thickness of the base part 30 is shown by a double-pointed arrow t1 in FIG. 4. The thickness t1 is measured along the radial direction. The thickness t1 (mm) is determined in view of the difference (d3−d1) between the inner diameter d3 (mm) of the large-diameter part 24 and the tip diameter d1 (mm) of the shaft 6. Specifically, the thickness t1 corresponds to a value S1 calculated in the following calculating formula.

$$S1=(d3-d1)/2$$

Specifically, the difference (S1−t1) is preferably 0.2 mm or less, and more preferably 0.1 mm or less. The deviation between the shaft axial line Z1 and the axial line Z2 of the hosel hole is suppressed by reducing the difference (S1−t1). The adhesive strength between the inner peripheral surface of the large-diameter part 24 and the base part 30 is likely to be enhanced by reducing the difference (S1−t1). From the viewpoint of facilitating the insertion of the base part 30 into the large-diameter part 24, the difference (S1−t1) is preferably 0.01 mm or more, more preferably 0.02 mm or more, and still more preferably 0.05 mm or more.

As described later, the inner diameter d3 of the large-diameter part 24 is preferably determined in accordance with a tip diameter of another shaft having the tip diameter larger than that of the shaft 6.

The inner diameter of the through-hole 31 of the ferrule 8 is determined in accordance with the tip diameter d1 of the shaft 6. As shown in FIG. 4, the inner diameter of the ferrule 8 decreases as it goes downward in a state where the shaft 6 is not inserted. The inner diameter of the ferrule 8 gradually decreases as it goes downward. The inner diameter d4 of the through-hole 31 in the upper end of the ferrule 8 is larger than the inner diameter d5 of the through-hole 31 in the lower end of the ferrule 8. The inner diameters d4, d5 are measured in a state where the shaft is not inserted.

From the viewpoint of facilitating the insertion of the shaft 6 into the through-hole 31, the inner diameter d4 is preferably made to be larger than the tip diameter d1 of the shaft 6. From this viewpoint, the inner diameter d4 is preferably set to (d1+0.05) mm or more, and more preferably (d1+0.07) mm or more. From the viewpoint of being likely to fix the ferrule 8 to the shaft 6, the inner diameter d4 is preferably made to be (d1+0.2) mm or less, and more preferably (d1+0.15) mm or less.

The inner diameter d5 is preferably smaller than the tip diameter d1 of the shaft 6. In this case, the shaft 6 is press fitted into the through-hole 31. The ferrule 8 is elastically deformed by this press fitting so that the through-hole 31 is expanded. The ferrule 8 is fixed to the shaft 6 due to the returning force of this elastic deformation to an original shape. The ferrule 8 is, therefore, fixed to the shaft 6 concurrently with the shaft 6 inserted into the ferrule 8. This fixing prevents the movement of the ferrule 8 on the shaft 6 in the assembling process of the club. The fixing can enhance the productivity of the club in the assembling process.

The position of the fixed ferrule 8 in the shaft 6 defines the length of the shaft 6 inserted into the hosel hole 22. The assembling accuracy of the golf club can be enhanced by ensuring the fixation of the ferrule 8 to the shaft 6.

From the viewpoint of facilitating the fixation of the ferrule 8 to the shaft 6, the inner diameter d5 (mm) is preferably made to be less than d1 (mm), more preferably (d1−0.1) mm or less, and still more preferably (d1−0.15) mm or less. From the viewpoints of facilitating the insertion of the shaft 6 into the through-hole 31 and of suppressing the damage of the ferrule 8 by press fitting, the inner diameter d5 is preferably made to be (d1−0.3) mm or more, and more preferably (d1−0.25) mm or more.

As shown in FIG. 2, an end surface 52 of the base part 30 and a bottom surface 54 of the large-diameter part 24 are separated from each other. The end surface 52 is a downward surface. The bottom surface 54 of the large-diameter part 24 is an upward surface. In the present application, a portion defined by the end surface 52, the bottom surface 54, an outer peripheral surface 58 of the shaft 6, and an inner peripheral surface 60 of the large-diameter part 24 is referred to as an enclosed part 62. The enclosed part 62 has a cylindrical shape. The axial directional length of this enclosed part 62 is (L1−L2). The length L1 and the length L2 will be described later.

As shown by the dotted pattern in FIG. 2, the adhesive v1 is disposed in the enclosed part 62. In the embodiment of FIG. 2, the enclosed part 62 is filled with the adhesive v1. The shaft 6 and the large-diameter part 24 are bonded by the adhesive v1 disposed in the enclosed part 62.

The adhesive v1 existing in the enclosed part 62 has a large radial thickness. It was considered that a sufficient adhesive strength was not obtained when the thickness of the adhesive layer was large as described above. However, the present invention found that a practical adhesive strength could be obtained even when the thickness of the adhesive layer was large. The small-diameter part 26 and the base part 30 of the ferrule are believed to contribute to this adhesive strength.

As shown by the thick line in FIG. 2, the adhesive v1 exists between the base part 30 and the large-diameter part 24. The base part 30 and the large-diameter part 24 are bonded by the adhesive v1. The ferrule 8 and the shaft 6 are hardly detached from the hosel hole 22 due to this bonding. The adhesive between the base part 30 and the large-diameter part 24 may not exist.

The adhesive may exist between the inner peripheral surface of the through-hole 31 of the ferrule 8 and the outer surface 6*a* of the shaft 6 (not shown). The ferrule is hardly detached from the shaft by bonding the ferrule 8 and the shaft 6. It is preferable that the inner surface of the ferrule is bonded to the shaft 6 and the outer surface of the ferrule is bonded to the inner peripheral surface 60 of the large-diameter part 24. This configuration increases the adhesive strength between the shaft 6 and the inner peripheral surface 60.

As shown by the thick line in FIG. 2, the adhesive v1 exists between the shaft 6 and the small-diameter part 26. The shaft 6 and the small-diameter part 26 are bonded by the adhesive v1. The adhesive v1 between the shaft 6 and the small-diameter part 26 may not exist.

The small-diameter part 26 plays a role of suppressing the deviation between the shaft axial line Z1 and the axial line Z2 of the hosel hole. Even when the shaft 6 and the small-diameter part 26 are not bonded, the small-diameter part 26 exhibits an effect for suppressing the deviation between the shaft axial line Z1 and the axial line Z2 of the hosel hole.

Figure 5:
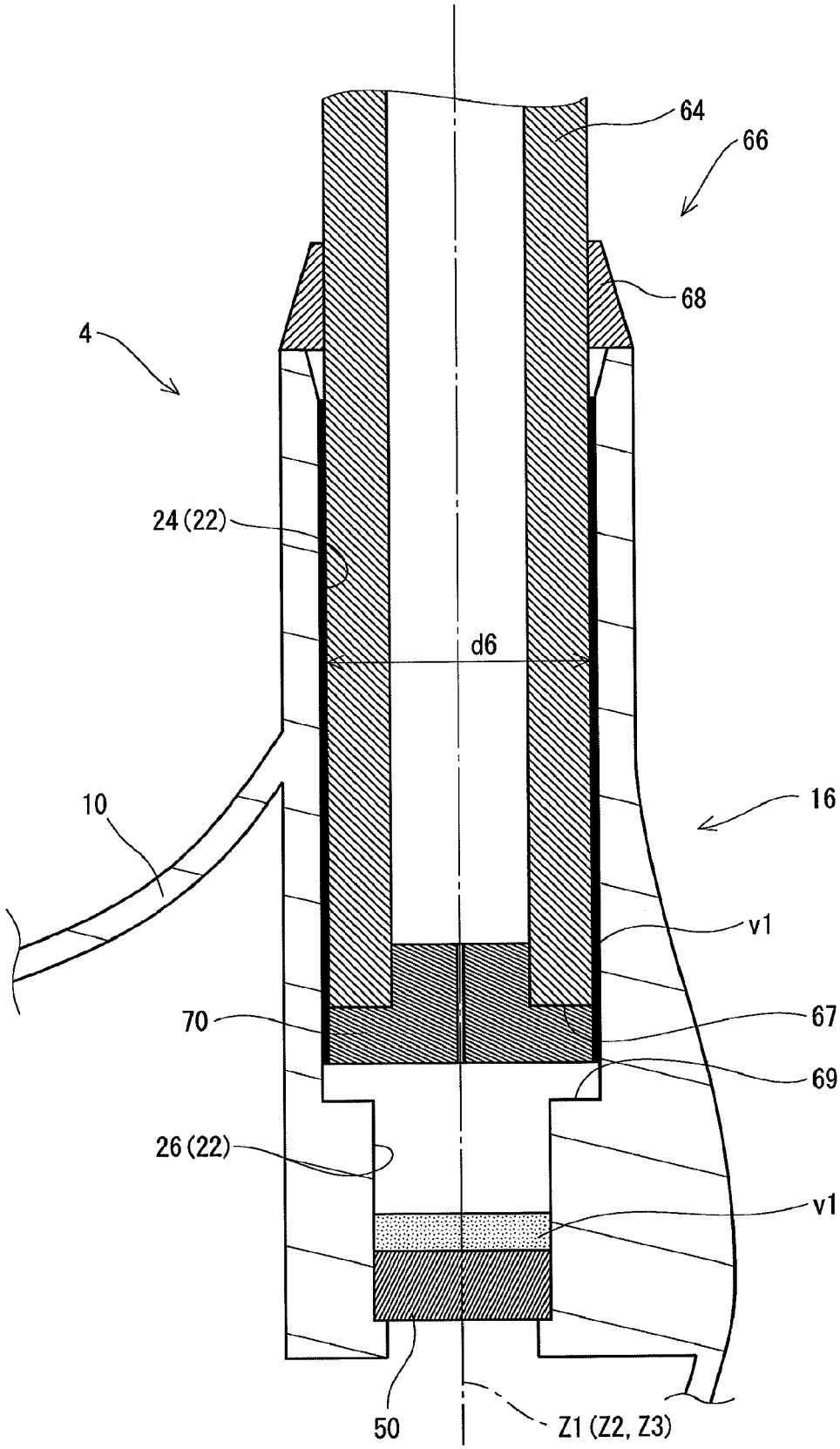
FIG. 5 is a sectional view of a golf club including the head shown in FIG. 1 and another shaft attached to the head, the shaft having a large tip diameter.

Another shaft having a tip diameter different from that of the shaft 6 in addition to the shaft 6 can be attached to the head 4. FIG. 5 is a sectional view of a golf club 66 in which a shaft 64 having a tip diameter larger than that of the shaft 6 is attached to the head 4.

The tip diameter d6 (mm) of the shaft 64 corresponds to the inner diameter d3 (mm) of the large-diameter part 24. Specifically, the difference (d3−d6) is preferably 0.2 mm or less, and more preferably 0.1 mm or less. The deviation between the shaft axial line Z1 and the axial line Z2 of the hosel hole is suppressed by reducing the difference (d3−d6). The adhesive strength between the inner peripheral surface of the large-diameter part 24 and the shaft 64 is likely to be enhanced by reducing the difference (d3−d6). From the viewpoint of facilitating the insertion of the shaft 64 into the large-diameter part 24, the difference (d3−d6) is preferably 0.01 mm or more, more preferably 0.02 mm or more, and still more preferably 0.05 mm or more.

The adhesive v1 exists between the outer peripheral surface of the shaft 64 and the inner peripheral surface of the large-diameter part 24. That is, the shaft 64 and large-diameter part 24 are bonded by the adhesive. The adhesive v1 is shown by a thick line in FIG. 5.

A golf club 66 has a ferrule 68. This ferrule 68 does not have a base part unlike in the ferrule 8. The ferrule 68 has the same form as that of a usual ferrule to be used widely. Thus, the ferrule 68 having the tip diameter corresponding to the large-diameter part 24 can be attached by using the ferrule 68 which does not have the base part.

The golf club 66 has the plug 50 and a bush 70. The plug 50 and the bush 70 may not exist.

As shown in FIG. 5, a tip end surface 67 of the shaft 64 and a bottom surface 69 of the large-diameter part 24 are not brought into contact with each other. A space exists between the tip end surface 67 and the bottom surface 69. The tip end surface 67 and the bottom surface 69 are separated from each other in the axial direction by this space. This configuration can suppress the deviation between the shaft axial line Z1 and the axial line Z2 of the hosel hole. Reason for this is as follows. When a plane including the tip end surface 67 and/or a plane including the bottom surface 69 is not perpendicular to the axial line Z2 of the hosel hole, the deviation between the axial line Z1 and the axial line Z2 may be generated by the abutment between the tip end surface 67 and the bottom surface 69. Also, when the tip end surface 67 and/or the bottom surface 69 are not a plane, the deviation between the axial line Z1 and the axial line Z2 may be generated by the abutment between the tip end surface 67 and the bottom surface 69. Therefore, the separation of the tip end surface 67 and the bottom surface 69 can suppress the deviation between the axial line Z1 and the axial line Z2.

Thus, the golf club 66 is provided with the head 4, the shaft 64 and the ferrule 68. The head 4 has the hosel hole 22. The hosel hole 22 has the large-diameter part 24 positioned at an opening side of the hosel hole and the small-diameter part 26 provided below the large-diameter part 24. The large-diameter part 24 is disposed coaxially with the small-diameter part 26. The shaft 64 has the tip diameter d6 larger than the small-diameter part 26. The golf club 66 uses the ferrule 8 having the base part 30 having a thickness corresponding to the difference (Rd−Rs) between a radius Rd of the large-diameter part 24 and a radius Rs of the small-diameter part 26 and inserts this base part 30 into the large-diameter part 24, and thereby the shaft 64 can be exchanged for another shaft 6 having the tip diameter equal to or below the inner diameter of the small-diameter part 26.

Thus, any of two kinds of shafts having different tip diameters can be attached to the head 4. Furthermore, a shaft having another tip diameter between the tip diameter d1 (shaft 6) and the tip diameter d6 (shaft 64) can be attached to the head 4 by adjusting the thickness t1 of the base part of the ferrule.

As described above, the present invention provides the golf club head enabling the shaft exchange between the shafts having different tip diameters. Hereinafter, a producing method of the golf club according to the present application and an exchanging method of the shaft according to the present application will be described.

In the descriptions of the following producing method and exchanging method, in order to distinguish two kinds of shafts having different tip diameters, the expressions of "shaft A" and "shaft B" are used. The shaft A, which means a shaft having a tip diameter larger than that of the shaft B, corresponds to the shaft 64 in the above mentioned embodiment. The shaft B, which means a shaft having a tip diameter smaller than that of the shaft A, corresponds to the shaft 6 in the above mentioned embodiment. In the following description, in order to distinguish the golf clubs in which two kinds of shafts having different tip diameters are attached, the expressions of "golf club X" and "golf club Y" are used. The golf club X, which means a golf club in which the shaft A is attached, corresponds to the golf club 66 in the above mentioned embodiment. The golf club Y, which means a golf club in which the shaft B is attached, corresponds to the golf club 2 in the above mentioned embodiment.

A producing method 1 of the golf club according to the present application is a producing method of a golf club in which the shaft having a large tip diameter is replaced to the shaft having a small tip diameter.

This producing method is a producing method of a golf club including the following steps of:

(1a) preparing the golf club X;

(1b) preparing a ferrule having a base part capable of being inserted into a large-diameter part of a hosel hole;

(1c) removing the shaft A bonded to the large-diameter part;

(1d) inserting the shaft B having a tip diameter smaller than that of the shaft A into the ferrule; and (1e) bonding the small-diameter part and the shaft B while interposing the base part between the shaft B and the large-diameter part. It should be noted that the golf club X has the golf club head and the shaft A. This head has the hosel hole. This hosel hole has the large-diameter part positioned at the opening side of the hosel hole and the small-diameter part provided below the large-diameter part. In this golf club X, the large-diameter part and the shaft A are bonded with each other.

A producing method 2 of the golf club according to the present application is a producing method of a golf club obtained by replacing a shaft having a small tip diameter to a shaft having a large tip diameter. This producing method is a producing method of a golf club including the following steps of:

(2a) preparing the golf club Y;

(2b) removing a ferrule including a base part interposed between a large-diameter part of a hosel hole and the shaft B;

(2c) removing the shaft B bonded to the small-diameter part of the hosel hole; and (2d) bonding the large-diameter part and the shaft A. It should be noted that the golf club Y has the ferrule, the golf club head, and the shaft B. This head has the hosel hole. This hosel hole has the large-diameter part positioned at the opening side of the hosel hole and the small-diameter part provided below the large-diameter part. In this golf club Y, the shaft B is inserted into the small-diameter part, and the base part of the ferrule is interposed between the large-diameter part and the shaft B.

A shaft exchanging method 1 of the golf club according to the present application is a shaft exchanging method replacing a shaft having a large tip diameter to a shaft having a small tip diameter. This exchanging method is a shaft exchanging method exchanging the shaft A attached to the golf club head into the shaft B having the smaller tip diameter than that of the shaft A. The head has the hosel hole. This hosel hole has the large-diameter part positioned at the opening side of the hosel hole and the small-diameter part provided below the large-diameter part.

The exchanging method is a shaft exchanging method of a golf club including the following steps of:

(3a) preparing a ferrule having a base part capable of being inserted into the large-diameter part;

(3b) removing the shaft A bonded to the large-diameter part;

(3c) inserting the shaft B into the ferrule;

(3d) interposing the base part between the shaft B and the large-diameter part; and (3e) inserting the shaft B into the small-diameter part.

A shaft exchanging method 2 of a golf club according to the present application is a shaft exchanging method replacing a shaft having a small tip diameter to the shaft having a large tip diameter. That is, this exchanging method is a shaft exchanging method exchanging the shaft B attached to the golf club head into the shaft A having the tip diameter larger than that of this shaft B. The head has the hosel hole, and this hosel hole has the large-diameter part positioned at the opening side of the hosel hole and the small-diameter part provided below this large-diameter part. The golf club before the shaft exchanging has a ferrule, a base part as a part of this ferrule interposed between the large-diameter part and the shaft B, and the shaft B bonded to the small-diameter part. The shaft exchanging method 2 is a shaft exchanging method of a golf club including the following steps of:

(4a) removing the ferrule;

(4b) removing the shaft B bonded to the small-diameter part; and (4c) bonding the large-diameter part and the shaft A.

The step of removing the shaft bonded to the hosel hole can be carried out using a known method. Usually, a method for drawing out the shaft from the hosel hole while heating the hosel part is adopted.

Figure 6:
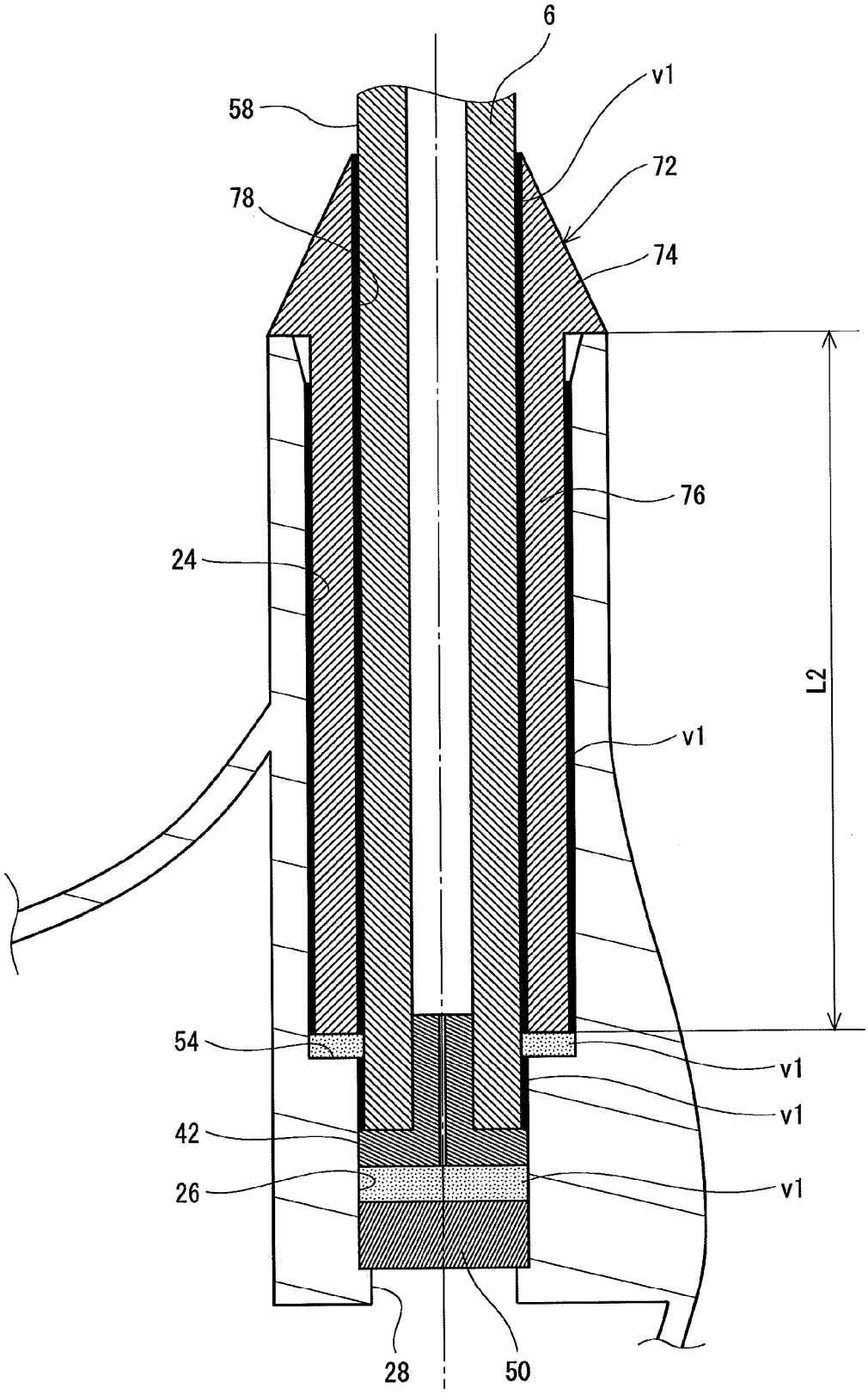
FIG. 6 is a sectional view of a golf club according to another embodiment.

FIG. 6 is a sectional view of a first modification of the embodiment of FIG. 2. The difference between the embodiment of FIG. 6 and the embodiment of FIG. 2 is only the axial directional length L2 of the base part. A ferrule 72 used in the embodiment of FIG. 6 has an exposed part 74 and a base part 76. The form of the exposed part 74 is the same as that of the exposed part 32 of the ferrule 8 described above.

Figure 7:
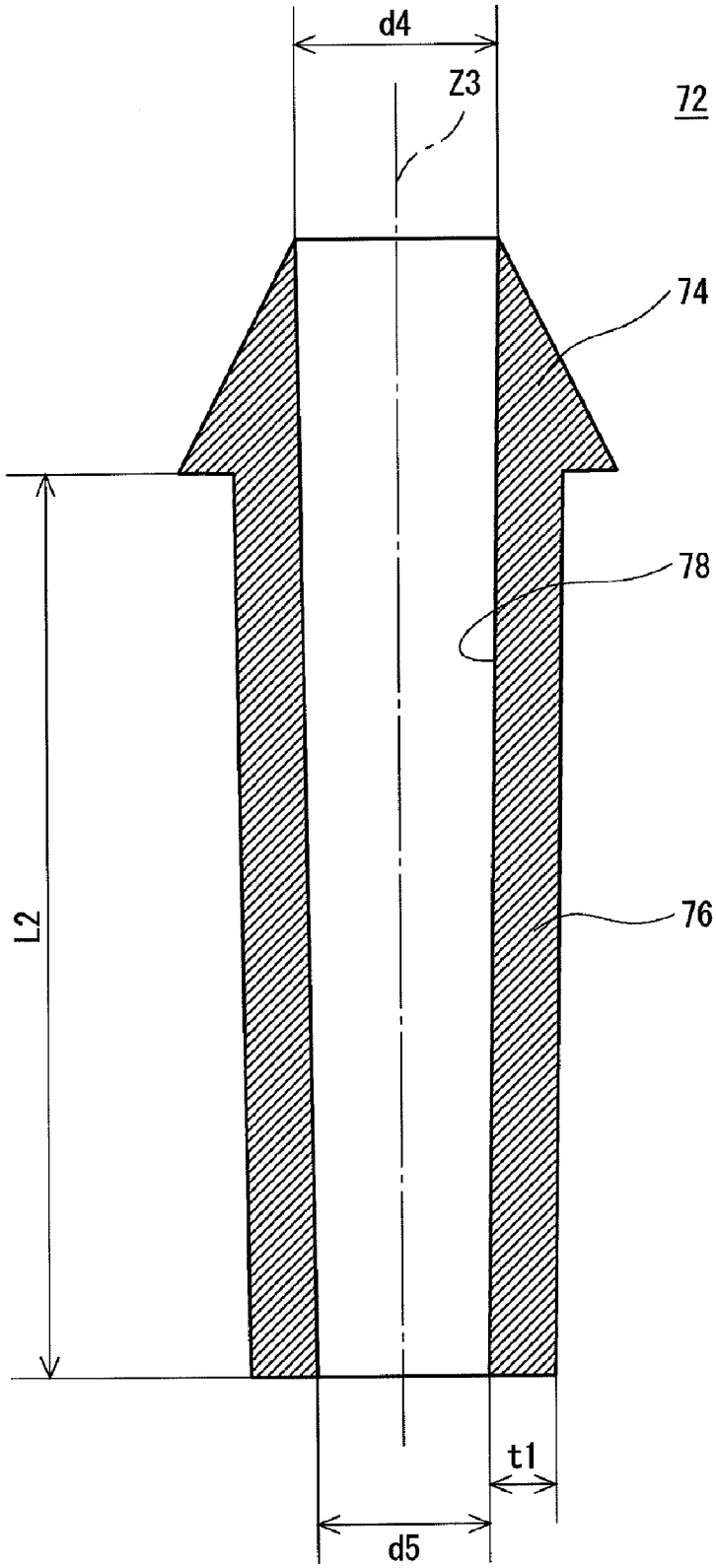
FIG. 7 is a sectional view of a ferrule used for the golf club of FIG. 6.

FIG. 7 is a sectional view of the ferrule 72 alone. The diameter of a through-hole 78 gradually decreases as it goes downward. The inner diameter d4 of the through-hole 78 in the upper end of the ferrule 72 is larger than the inner diameter d5 of the through-hole 78 in the lower end of the ferrule 72. The inner diameter d4 and the inner diameter d5 are measured in a state where the shaft is not inserted. The inner diameter d4 and the inner diameter d5 are set as in the ferrule 8 shown in FIG. 4. The thickness t1 of the base part is also set as in the ferrule 8.

As shown in FIG. 6, the adhesive v1 exists between the outer peripheral surface of the base part 76 and the inner peripheral surface of the large-diameter part 24. The large-diameter part 24 and the base part 76 are bonded by the adhesive v1. The adhesive v1 exist between the inner peripheral surface of the through-hole 78 and the outer peripheral surface 58 of the shaft 6. The inner peripheral surface of the through-hole 78 and the outer peripheral surface 58 are bonded by the adhesive v1.

The axial directional length L2 of the base part corresponds to the axial directional length L1 (see FIG. 3) of the large-diameter part 24. It should be noted, the length L2 is shorter than the length L1. As long as the axial directional length L2 of the base part is made to be shorter than the length L1, the length L2 is not limited.

Figure 8:
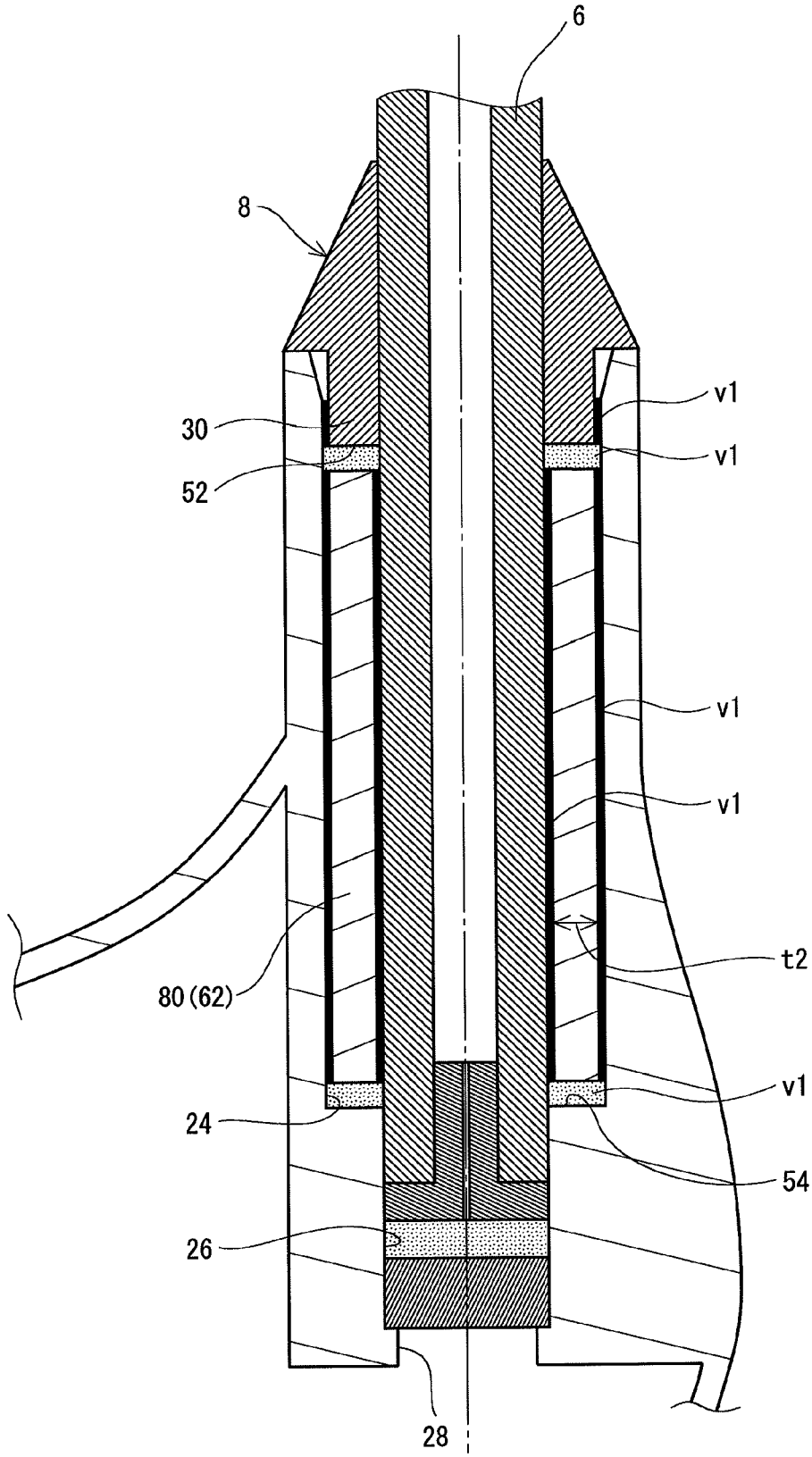
FIG. 8 is a sectional view of a golf club according to another embodiment.

FIG. 8 is a sectional view of a second modification of the embodiment of FIG. 2. The difference between the embodiment of FIG. 8 and the embodiment of FIG. 2 is only the existence or nonexistence of an interposition member 80. The interposition member 80 is disposed in the enclosed part 62 described above. Surprisingly, it was found that the interposition member 80 could enhance the adhesive strength between the shaft 6 and the large-diameter part 24. The interposition member 80 is obtained by rolling a plate member into a cylindrical shape. As the interposition member 80, a metal plate is exemplified. As the material of the interposition member 80, aluminum, copper, lead, an aluminium alloy, a copper alloy and a lead alloy are exemplified from the viewpoints of simple bending processing and of the adhesive strength between the shaft and the large-diameter part 24.

The adhesive v1 exists on the inner side (inner side in the radial direction) of the interposition member 80. That is, the shaft 6 and the interposition member 80 are bonded by the adhesive v1. The adhesive v1 exists on the outer side (outer side in the radial direction) of the interposition member 80.

That is, the large-diameter part 24 and the interposition member 80 are bonded by the adhesive v1.

The thickness t2 of the interposition member 80 is made to be smaller than the value S1. From the viewpoint of securing a space for the existence of the adhesive v1, the thickness t2 of the interposition member 80 is preferably 90% or less of the value S1, and more preferably 80% or less. From the viewpoint of enhancing the adhesive strength between the shaft 6 and the large-diameter part 24, the thickness t2 is preferably 50% or more of the value S1, and more preferably 70% or more.

From the viewpoint of enhancing the adhesive strength between the shaft 6 and the large-diameter part 24, the layer thickness of the adhesive v1 between the interposition member 80 and the shaft 6 is preferably 0.10 mm or less, and more preferably 0.08 mm or less. From the viewpoint of enhancing the adhesive strength between the shaft 6 and the large-diameter part 24, the layer thickness of the adhesive v1 between the interposition member 80 and the shaft 6 is preferably 0.01 mm or more, and more preferably 0.03 mm or more.

From the viewpoint of enhancing the adhesive strength between the shaft 6 and the large-diameter part 24, the layer thickness of the adhesive v1 between the interposition member 80 and the large-diameter part 24 is preferably 0.10 mm or less, and more preferably 0.08 mm or less. From the viewpoint of enhancing the adhesive strength between the shaft 6 and the large-diameter part 24, the layer thickness of the adhesive v1 between the interposition member 80 and the large-diameter part 24 is preferably 0.01 mm or more, and more preferably 0.03 mm or more.

The shape of the interposition member 80 is not limited. It is preferable that the interposition member 80 has a particle shape in addition to the cylindrical shape described above. As this interposition member, sands, gravels and metal particles are exemplified. It is preferable that the interposition member having the particle shape is previously mixed with the adhesive v1 from the viewpoint of the workability. The particle diameter of the interposition member having the particle shape is not limited as long as the particle diameter is made to be shorter than the value S1.

From the viewpoint of the adhesive strength, the axial directional length L1 of the large-diameter part 24 is preferably 20 mm or more, and more preferably 30 mm or more. When the hosel is excessively long, the position of the center of gravity of the head is apt to be excessively high or be excessively closer to a heel thus reducing the design flexibility of the head. From this viewpoint, the axial directional length L1 of the large-diameter part 24 is preferably 50 mm or less, and more preferably 45 mm or less. The axial direction length L1 of the large-diameter part 24 can correlate with the adhesive strength between the head and the shaft not only when the shaft (the shaft 64 in the embodiment) having the large tip diameter is attached but also when the shaft (the shaft 6 in the embodiment) having the small tip diameter is attached. As in the embodiment of FIG. 2, this is because the adhesive v1 exists between the shaft 6 and the large-diameter part 24.

From the viewpoint of the adhesive strength, the area of the inner peripheral surface of the large-diameter part 24 is preferably 500 $mm^2$ or more, and more preferably 700 $mm^2$ or more. When the hosel is excessively large, the position of the center of gravity of the head is apt to be excessively high or be excessively closer to a heel thus reducing the design flexibility of the head. From this viewpoint, the area of the inner peripheral surface of the large-diameter part 24 is preferably 1500 $mm^2$ or less, and more preferably 1300 $mm^2$ or less.

The axial directional length of the small-diameter part is shown by a double-pointed arrow L3 in FIG. 3. When the shaft having the small tip diameter (the shaft 6 in the above mentioned embodiment) is attached in the case where the axial directional length L3 of the small-diameter part is excessively short, the deviation between the axial line Z2 of the hosel hole and the shaft axial line Z1 is apt to be generated. From this viewpoint, the axial directional length L3 of the small-diameter part is preferably 1 mm or more, and more preferably 2 mm or more. When the hosel is excessively long, the position of a center of gravity of the head is apt to be excessively high or be excessively closer to a heel thus reducing the design flexibility of the head. From this viewpoint, the axial directional length L3 of the small-diameter part is preferably 15 mm or less, more preferably 10 mm or less, and still more preferably 5 mm or less.

The insertion length of the shaft 6 into the small-diameter part 26 is shown by a double-pointed arrow L4 in FIG. 2. From the viewpoint of suppressing the deviation between the axial line Z2 of the hosel hole and the shaft axial line Z1, the insertion length L4 is preferably 1 mm or more, and more preferably 2 mm or more. When the hosel is excessively long, the position of the center of gravity the head is apt to be excessively high or be excessively closer to a heel thus reducing the design flexibility of the head. When the insertion length L4 is excessively long, the weight of the shaft increases, and thus increasing the total weight of the club. From this viewpoint, the insertion length L4 is preferably 10 mm or less, more preferably 7 mm or less, and still more preferably 5 mm or less.

From the viewpoint of suppressing the damage of the base part itself, the axial directional length L2 of the base part is preferably 22 mm or less, more preferably 20 mm or less, and still more preferably 18 mm or less. From the viewpoint of suppressing the deviation between the shaft axial line Z1 and the axial line Z2 of the hosel hole, the axial directional length L2 of the base part is preferably 4 mm or more, more preferably 6 mm or more, and still more preferably 8 mm or more.

A ratio (L2/L1) of the axial directional length L2 (mm) of the base part to the axial directional length L1 (mm) of the large-diameter part 24 is preferably within the following range. When the ratio (L2/L1) is excessively large, the base part itself of the ferrule is apt to be damaged. When the damage of the base part takes place, the shaft is apt to be pulled out from the head. When the length L1 is excessively small, the adhesive strength between the head and the shaft is apt to be reduced. From the viewpoint of enhancing the adhesive strength while suppressing the damage of the base part, the ratio (L2/L1) is preferably 0.5 or less, more preferably 0.4 or less, and still more preferably 0.3 or less. From the viewpoint of suppressing the excessively short length L2 or the excessively long length L1, the ratio (L2/L1) is preferably 0.05 or more, and more preferably 0.1 or more.

The outer diameter of the base part is shown by a double-pointed arrow d7 in FIG. 2. The outer diameter d7 of this base part is measured in a state where the shaft is inserted. In other words, the outer diameter d7 of this base part is measured in the state of the golf club. From the view point of facilitating the insertion of the base part into the large-diameter part, the difference (d3−d7) between the outer diameter d7 (mm) of this base part and the inner diameter d3 (mm) of the large-diameter part 24 described above is preferably 0.05 mm or more, and more preferably 0.1 mm or more, and 0.15 mm or more. From the viewpoint of suppressing the deviation between the shaft axial line Z1 and the axial line Z2 of the hosel hole, the difference (d3−d7) is preferably 0.3 mm or less, and more preferably 0.25 mm or less.

The radial thickness of the enclosed part 62 is shown by a double-pointed arrow t3 in FIG. 2. From the viewpoint of enhancing the adhesive strength between the shaft 6 and the large-diameter part 24, the thickness t3 is preferably 1 mm or less, more preferably 0.5 mm or less, and still more preferably 0.3 mm or less. From the viewpoint of increasing the difference between the tip diameter d1 and the tip diameter d6 to increase the range of the tip diameter of the shaft capable of being attached, the thickness t3 is preferably 0.1 mm or more, and more preferably 0.2 mm or more. The thickness t3 is equal to the value S1.

The inner diameter d2 of the small-diameter part 26 is not limited. From the viewpoint of increasing the tip diameter d1 to enhance the strength of the tip part of the shaft, the inner diameter d2 is preferably 7.1 mm or more, more preferably 7.6 mm or more, still more preferably 8.1 mm or more, and particularly preferably 8.4 mm or more. From the viewpoint of increasing the difference between the inner diameter d2 and the inner diameter d3 to extend the range of the tip diameter of the shaft capable of being attached, the inner diameter d2 is preferably 8.8 mm or less, and more preferably 8.7 mm or less.

The inner diameter d3 of the large-diameter part 24 is not limited. From the viewpoint of reducing the tip diameter d6 thus reducing the rigidity of the tip part of the shaft to be easy to hit golf balls, the inner diameter d3 is preferably 10.6 mm or less, more preferably 10.1 mm or less, and still more preferably 9.6 mm or less. From the viewpoint of increasing the difference between the inner diameter d3 and the inner diameter d2 to extend the range of the tip diameter of the shaft capable of being exchanged, the inner diameter d3 is preferably 8.8 mm or more, and more preferably 8.9 mm or more.

The difference (d3−d2) between the inner diameter d3 and the inner diameter d2 is not limited. From the viewpoint of extending the range of the tip diameter of the shaft capable of being attached, the difference (d3−d2) is preferably 0.2 mm or more, more preferably 0.3 mm or more, and still more preferably 0.4 mm or more. From the viewpoint of enhancing the adhesive strength when the shaft having the tip diameter d1 is attached, the difference (d3−d2) is 1.5 mm or less, more preferably 1.0 mm or less, and still more preferably 0.7 mm or less.

In view of the tip diameter of the shaft to be used widely in the wood type golf club, the inner diameter d2 of the small-diameter part is preferably no less than 8.4 mm and no more than 8.6 mm, and the inner diameter d3 of the large-diameter part is preferably no less than 8.9 mm and no more than 9.1 mm.

The tip diameter d1 of the shaft corresponding to the small-diameter part 26 is not limited. From the viewpoint of the strength of the tip part of the shaft, the tip diameter d1 is preferably 7 mm or more, more preferably 7.5 mm or more, still more preferably 8.0 mm or more, and particularly preferably 8.3 mm or more. From the viewpoint of increasing the difference between the tip diameter d1 and the tip diameter d6 to extend the range of the tip diameter of the shaft capable of being exchanged, the tip diameter d1 is preferably 8.7 mm or less, and more preferably 8.6 mm or less.

The tip diameter d6 of the shaft corresponding to the large-diameter part 24 is not limited. From the viewpoint of reducing the rigidity of the shaft tip part in order to facilitate hitting of golf balls, the tip diameter d6 is preferably 10.5 mm or less, more preferably 10 mm or less, and still more preferably 9.5 mm or less. From the viewpoint of increasing the difference between the tip diameter d6 and the tip diameter d1 to extend the range of the tip diameter of the shaft capable of being exchanged, the tip diameter d6 is preferably 8.8 mm or more, and more preferably 8.9 mm or more.

In view of the tip diameter of the shaft to be used widely in the wood type golf club, the tip diameter d1 is preferably no less than 8.4 mm and no more than 8.6 mm, and the tip diameter d6 is preferably no less than 8.9 mm and no more than 9.1 mm.

Figure 9:
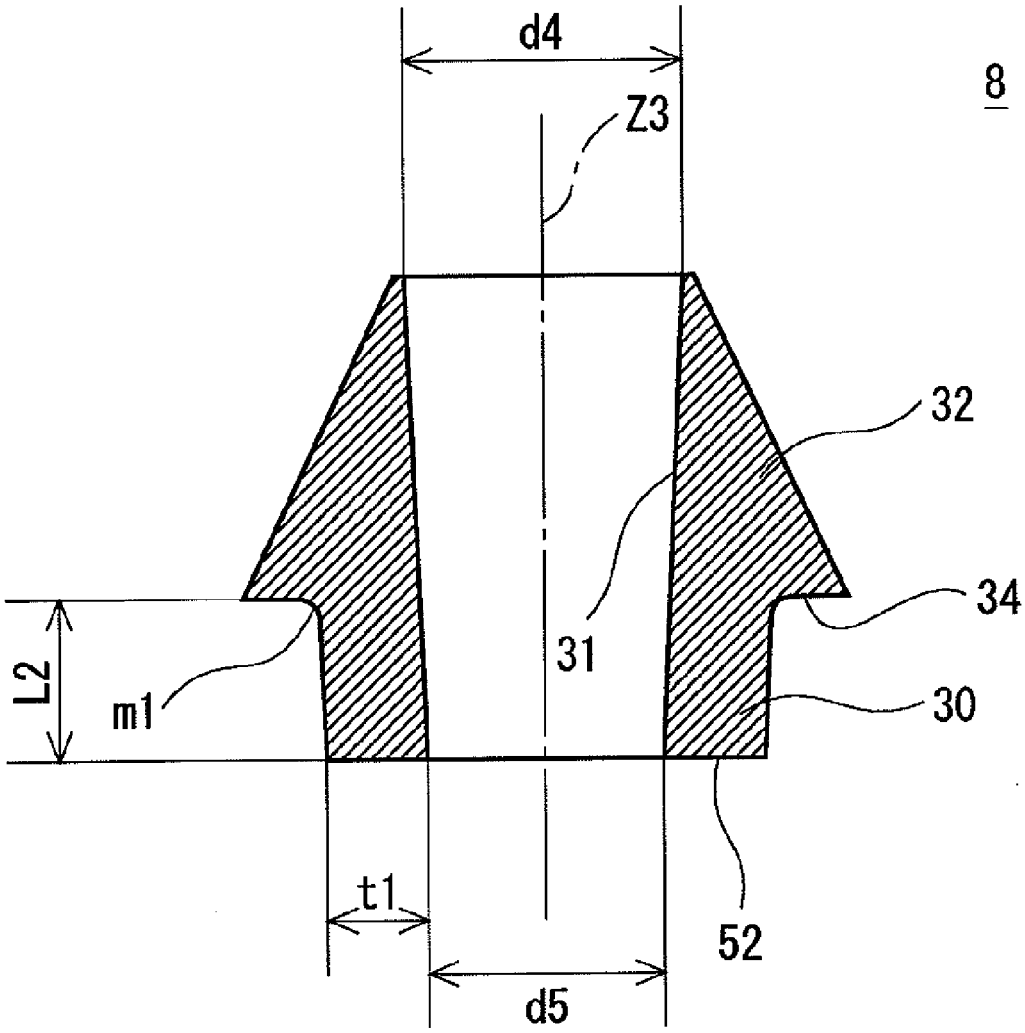
FIG. 9 is a sectional view of a ferrule according to a modification.

FIG. 9 is a sectional view showing a modification of the ferrule. In this ferrule, a chamfer m1 is formed on the boundary between the exposed part 32 and the base part 30. The boundary between the exposed part 32 and the base part 30 is rounded. This chamfer (round) m1 can suppress the damage of the ferrule and enhance the durability of the shaft. The surface of the chamfer m1 may be a plane or a curved surface as shown in FIG. 9. From the viewpoint of preventing a gap between the bump surface 34 and the hosel end surface 36 while enhancing the reinforcing effect of the ferrule, the curvature radius (rounding curvature radius) of the chamfer m1 is preferably 2 mm or more, and preferably 5 mm or less. A recess (not shown) may be formed on the bump surface 34. The adhesive strength between the bump surface 34 and the hosel end surface 36 is enhanced by providing the adhesive on this recess to suppress the disconnection of the ferrule.

A recess such as a groove (not shown) may be formed on the outer peripheral surface of the base part 30. The groove may extend in the axial direction, be spirally formed, and extend in the circumferential direction. A slit may be formed in the base part 30. The adhesive strength between the ferrule and the hosel hole can be enhanced by providing the adhesive in the groove or the slit.

The material of the ferrule is not limited. However, from the viewpoint of enabling the elastic deformation described above, a resin is preferable. Preferred examples of the materials of the ferrule include cellulose acetate, cellulose nitrate, an ABS resin, and polypropylene. From the viewpoint of workability in a finishing process in assembling the golf club, cellulose acetate or cellulose nitrate is more preferable, and cellulose acetate is more preferable.

The preferred resin has a comparatively weak strength. Therefore, when the ratio (L2/L1) is increased and the material of the ferrule is the preferred resin, the damage of the ferrule is apt to take place. From the viewpoints of suppressing the damage of the ferrule and of improving the workability, the ratio (L2/L1) is preferably made to be the preferred value or less, and the material of the ferrule is particularly preferably cellulose acetate or cellulose nitrate.

The kind of the adhesive v1 is not limited. As the adhesive capable of being used, an epoxy adhesive, an acrylic adhesive, and a urethane adhesive are exemplified. From the viewpoint of the adhesive strength, the epoxy adhesive is preferable. The adhesive may be a one-component cure type adhesive or a two-component cure type adhesive. Preferred examples of the epoxy adhesives include "Y611 black S" (trade name) produced by Cemedine Co., Ltd.

As shown in FIG. 3, the axial directional length L1 of the large-diameter part 24 is longer than the axial directional length L3 of the small-diameter part. That is, the length L1 is longer than the length L3. The prior literature described above describes a hosel hole having a large-diameter part and a small-diameter part. However, the length L1 is shorter than the length L3 in the prior literature. In the prior literature, a ferrule base part is provided from the viewpoint of relaxing stress concentration, and the large-diameter part is provided from the viewpoint of securing a space storing this ferrule base part. The ferrule base part for relaxing the stress concentration need not to be lengthened. Conversely, when the ferrule base part is lengthened, the adhesive strength of the shaft is apt to be reduced. In the prior literature, the ferrule base part is short, and the axial directional length of the large-diameter part is also short. In the prior literature, in order to enlarge the adhesion area between the shaft and the hosel hole, the axial directional length of the large-diameter part was shortened, and the axial directional length of the small-diameter part was lengthened. As a result, conventionally, the length L1 was shorter than the length L3. As described above, the present invention is base on a technical thought different from the conventional technique. As a result, the length L1 is longer than the length L3 in the present invention.

A method for forming the large-diameter part and the small-diameter part is not limited. The large-diameter part and the small-diameter part may be simultaneously molded by casting. The large-diameter part and the small-diameter part may be formed by drilling processing using a drill press or the like. A holes having the same hole diameter as that of the large-diameter part may be molded by casting, and the bottom surface of this hole may be subjected to drilling processing for forming the small-diameter part. A hole having the same hole diameter as that of the small-diameter part may be molded by casting, and the opening side of this hole may be expanded by drilling processing.

EXAMPLES

Hereinafter, the effects of the present invention will be clarified by examples. However, the present invention should not be interpreted in a limited way based on the description of examples.

[Adhesive Strength Test]

Figure 10:
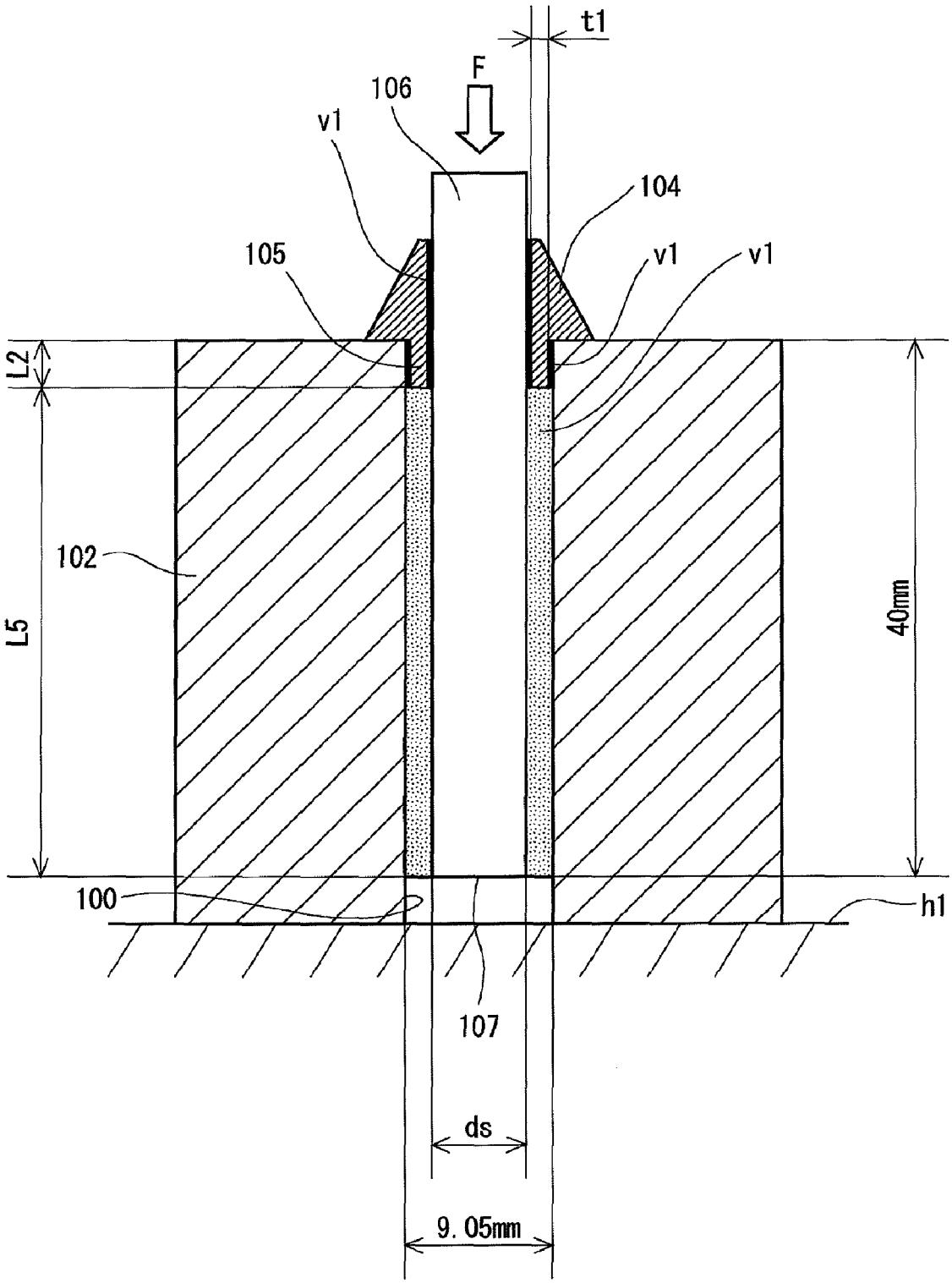
FIG. 10 shows a test method for an adhesive strength.
Figure 11:
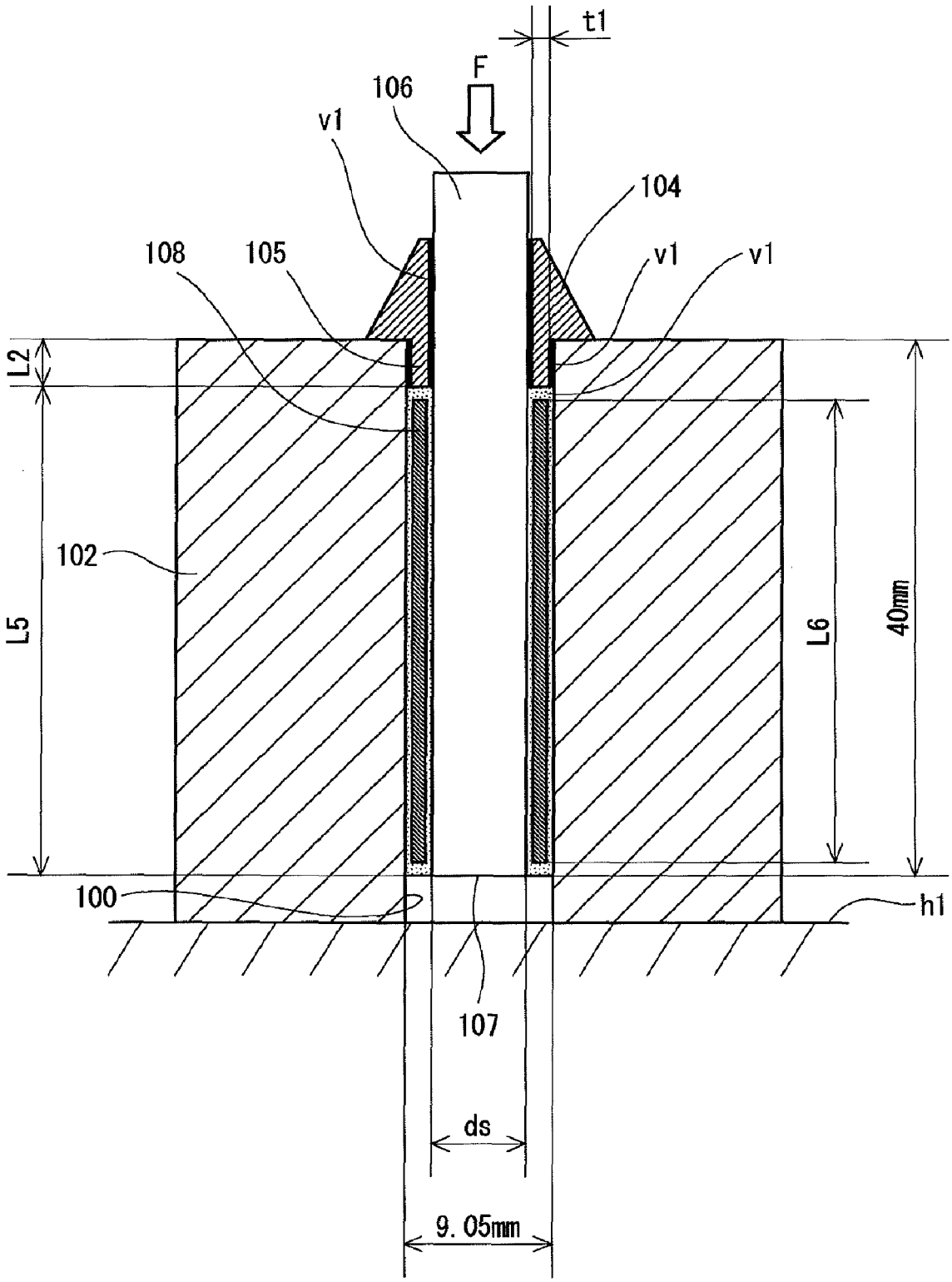
FIG. 11 shows a test method for an adhesive strength.

FIGS. 10 and 11 describe a method of an adhesive strength test. In this test, a jig 102 provided with a hole 100 having a diameter of 9.05 mm, a ferrule 104, and a shaft 106 of which only the vicinity of a tip part was cut out were used. As shown in FIGS. 10 and 11, the insertion length of the shaft 106 into the hole 100 was made to be 40 mm. This insertion length corresponds to the axial directional length L1 of the large-diameter part in an actual head. Consequently, the following Table 1 describes that the length L1 is 40 mm. The outer diameter of the shaft and the specification of the ferrule were coincided with the specification in each of examples. The shaft 106 and the hole 100 were bonded while the ferrule 104 was disposed. That is, as shown in FIGS. 10 and 11, the configuration of a hosel part of a golf club was schematically duplicated using the jig 102. FIGS. 10 and 11 show a case where the ferrule 104 has a base part 105. However, as shown in the following Table 1, example in which the ferrule does not have the base part also exists. A double-pointed arrow L5 shows the axial directional length of an adhesive layer which exists below the base part. In a state where the axial line of the hole 100 faces to the vertical direction, the jig 102 was left at rest on a level surface h1. A space is secured between a tip end surface 107 of the shaft 106 and the level surface h1. As shown in FIGS. 10 and 11, a vertically downward load F was applied to the upper end of the shaft 106 after being bonded. As a testing device, "Intesco (load cell: 2t)" produced by Intesco Co., Ltd. was used. The load F was gradually increased, and a load F1 at the moment of an adhesive disengaged was measured. This load F1 is shown as "adhesive strength" in the following Table 1.

In all of the test examples, "Y611 black S" (trade name) produced by Cemedine Co., Ltd. was used as the adhesive.

FIG. 11 shows test example 2. In the test example 2, an interposition member 108 was used as in the above mentioned embodiment of FIG. 8. As this interposition member 108, a copper plate was used. The interposition member 108 is obtained by rounding a plate member in cylindrical form. The thickness of the interposition member 108 was made to be 0.20 mm, and an axial directional length L6 of the interposition member 108 was made to be 30 mm. As shown in FIG. 11, an adhesive v1 exists between the interposition member 108 and the hole 100, and an adhesive v1 exists also between the interposition member 108 and the shaft 106.

Test Example 1

A ferrule which did not have a base part was prepared, and an adhesive was applied to the inner peripheral surface of this ferrule. A shaft having a diameter of 9.00 mm was then press fitted into the ferrule. The position of the ferrule was set so as that the insertion length of the shaft into a hole was made to be 40 mm (see FIG. 10). An adhesive was then applied to the surface of the shaft. The shaft was then inserted into the hole of a jig, and the shaft and the hole were bonded. The adhesive was cured, and the nonexistence of the adhesive below the tip end surface of the shaft was confirmed to obtain a testing body. The following Table 1 shows the evaluation result of this testing body.

Test Example 2

A ferrule which had a base part was prepared, and an adhesive was applied to the inner peripheral surface of this ferrule. A shaft having a diameter of 8.50 mm was then press fitted into the ferrule. The axial directional length L2 of the base part was made to be 5 mm. The position of the ferrule was set so as that the insertion length of the shaft into a hole was made to be 40 mm (see FIG. 11). An adhesive was then applied to the surface of the shaft and the surface of the base part of the ferrule. A copper plate was wound on the surface of the shaft. The specification of the copper plate is described above. The adhesive was applied to the outer surface of the copper plate. The shaft on which the copper plate was wound and the base part were then inserted into the hole of a jig, resulting in a state shown in FIG. 11. The adhesive was cured, and the nonexistence of the adhesive below the tip end surface of the shaft was confirmed to obtain a testing body. The following Table 1 shows the evaluation result of this testing body.

Test Example 3

A ferrule which had a base part was prepared, and an adhesive was applied to the inner peripheral surface of this ferrule. An axial directional length L2 of a base part was made to be 5 mm. A shaft having a diameter of 8.50 mm was then press fitted into the ferrule. The position of the ferrule was set so as that the insertion length of the shaft into a hole was made to be 40 mm (see FIG. 10). An adhesive was then applied to the surface of the shaft and the surface of the base part of the ferrule. The shaft and the base part were then inserted into the hole of a jig, and as shown in FIG. 10, the shaft and the base part were bonded to the hole. The adhesive was cured, and the nonexistence of the adhesive below the tip end surface of the shaft was confirmed to obtain a testing body. The following Table 1 shows the evaluation result of this testing body.

Test Example 4

A testing body of test example 4 was obtained in the same manner as in the test example 3 except that an axial directional length L2 of a base part was made to be 39 mm. The following Table 1 shows the evaluation result of this testing body.

Test Example 5

A ferrule which had a base part was prepared, and an adhesive was applied to the inner peripheral surface of this ferrule. An axial directional length L2 of a base part was made to be 5 mm. A shaft having a diameter of 8.50 mm was then press fitted into the ferrule. The position of the ferrule was set so as that the insertion length of the shaft into a hole was made to be 40 mm (see FIG. 10). An adhesive was then applied to only the surface of the base part of the ferrule. The adhesive was not applied to the surface of the shaft. Furthermore, the adhesive adhering on the surface of the shaft was wiped off. The shaft and the base part were then inserted into the hole of a jig, and the base part was bonded to the hole. The adhesive was cured, and the nonexistence of the adhesive below the tip end surface of the shaft was confirmed to obtain a testing body. In this test example 5, the base part and the hole are bonded. However, the shaft and the hole are not bonded. The test example 5 has a form in which the adhesive v1 shown by the dotted pattern were removed from the embodiment of FIG. 10. The following Table 1 shows the evaluation result of this testing body.

Test Examples 6 to 8

Testing bodies of the test examples 6 to 8 were obtained in the same manner as in the test example 3 except that an axial directional length L2 of a base part was made as shown in Table 1. The following Table 1 shows the evaluation result of these testing bodies.

The above description is only illustrative and various changes can be made without departing from the scope of the present invention.

What is claimed is:

1. A golf club comprising: a golf club head; a shaft and a ferrule, wherein the head has a hosel hole;

the hosel hole has a large-diameter part positioned at an opening side of the hosel hole and a small-diameter part provided below the large-diameter part;

the ferrule has a base part interposed between the large-diameter part and the shaft;

the large-diameter part is coaxial with the small-diameter part;

the shaft has a tip end surface disposed in the small-diameter part;

the large-diameter part has an axial directional length longer than an axial directional length of the small-diameter part;

the base part has an end surface separated from a bottom surface of the large-diameter part; and an adhesive and an interposition member are disposed in an enclosed part defined by the end surface of the base part, the bottom surface of the large-diameter part, an outer peripheral surface of the shaft, and an inner peripheral surface of the large-diameter part.

2. The golf club according to claim 1, wherein the base part has an axial directional length half or smaller than an axial directional length of the large-diameter part.

3. The golf club according to claim 1, wherein the large-diameter part has an axial directional length of 20 mm or more.

TABLE 1

Specifications and Evaluation Results of Test Examples

| | Unit | Test Example 1 | Test Example 2 | Test Example 3 | Test Example 4 | Test Example 5 | Test Example 6 | Test Example 7 | Test Example 8 |
|---|---|---|---|---|---|---|---|---|---|
| Hole Diameter of Jig | mm | 9.05 | 9.05 | 9.05 | 9.05 | 9.05 | 9.05 | 9.05 | 9.05 |
| Length L1 | mm | 40 | 40 | 40 | 40 | 40 | 40 | 40 | 40 |
| Shaft Tip Diameter ds | mm | 9.00 | 8.50 | 8.50 | 8.50 | 8.50 | 8.50 | 8.50 | 8.50 |
| Thickness t1 of Base Part | mm | No Base Part | 0.25 | 0.25 | 0.25 | 0.25 | 0.25 | 0.25 | 0.25 |
| Axial Directional Length L2 of Base Part | mm | 0 | 5 | 5 | 39 | 5 | 12 | 20 | 28 |
| Ratio (L2/L1) | — | 0.00 | 0.13 | 0.13 | 0.98 | 0.13 | 0.30 | 0.50 | 0.70 |
| Length L5 | mm | 40 | 35 | 35 | 1 | 0 | 28 | 20 | 12 |
| Existence or Nonexistence of Interposition Member | — | Non-existence | Existence | Non-existence | Non-existence | Non-existence | Nonexistence | Nonexistence | Nonexistence |
| Length L6 | mm | — | 30 | — | — | — | — | — | — |
| Adhesive Strength | kgf | 1880 | 1650 | 1448 | 808 | 612 | 1224 | 1056 | 914 |

The test example 1 corresponds to the above mentioned embodiment of FIG. 5. The test example 2 corresponds to the above mentioned embodiment of FIG. 8. The test example 3 corresponds to the above mentioned embodiment of FIG. 2. The test example 4 corresponds to the above mentioned embodiment of FIG. 6. The test example 5 corresponds to the case where the adhesive is not disposed in the enclosed part 62 in the above mentioned embodiment of FIG. 2. The test examples 6, 7, and 8, which correspond to the above mentioned embodiment of FIG. 2, show the effect of the length L2 with the test example 3. From the evaluation results of Table 1, the advantages of the present invention are apparent.

The present invention can be applied to all the golf clubs such as the wood type golf club, the iron type golf club, and a putter.

4. The golf club according to claim 1, wherein if an inner diameter of the large-diameter part is d3 (mm), a tip diameter of the shaft is d1 (mm) and a value calculated in the following calculating formula (1) is S1, a thickness t2 of the interposition member is 50% or more of the value S1, and the thickness t2 of the interposition member is 90% or less of the value S1:

$$S1=(d3-d1)/2 \quad (1).$$

5. The golf club according to claim 1, wherein an area of the inner peripheral surface of the large-diameter part is 500 $mm^2$ or more, and 1500 $mm^2$ or less.

6. The golf club according to claim 1, wherein an axial directional length L3 of the small-diameter part is 1 mm or more, and 15 mm or less.

7. The golf club according to claim 1, wherein an insertion length L4 of the shaft into the small-diameter part is 1 mm or more, and 10 mm or less.

8. The golf club according to claim 1, wherein an axial directional length L2 of the base part is 4 mm or more, and 22 mm or less.

9. The golf club according to claim 1, wherein a ratio (L2/L1) of an axial directional length L2 (mm) of the base part to an axial directional length L1 (mm) of the large-diameter part is 0.05 or more, and 0.5 or less.

10. The golf club according to claim 1, wherein a difference (d3−d7) between an outer diameter d7 (mm) of the base part and an inner diameter d3 (mm) of the large-diameter part is 0.05 mm or more, and 0.3 mm or less.

11. The golf club according to claim 1, wherein a radial thickness t3 of the enclosed part is 0.1 mm or more, and 1 mm or less.

12. The golf club according to claim 1, wherein a difference (d3−d2) between an inner diameter d3 (mm) of the large-diameter part and an inner diameter d2 (mm) of the small-diameter part is 0.2 mm or more, and 1.5 mm or less.

* * * * *